US010060694B2

(12) United States Patent
Kresser

(10) Patent No.: US 10,060,694 B2
(45) Date of Patent: Aug. 28, 2018

(54) HAMMER WITH ROTATABLE SPUR

(71) Applicant: Taurus International Manufacturing, Inc., Miami, FL (US)

(72) Inventor: Mark Kresser, Miramar, FL (US)

(73) Assignee: Taurus International Manufacturing, Inc., Miami, FL (US)

( * ) Notice: Subject to any disclaimer, the term of this patent is extended or adjusted under 35 U.S.C. 154(b) by 1171 days.

(21) Appl. No.: 14/244,257

(22) Filed: Apr. 3, 2014

(65) Prior Publication Data

US 2018/0010873 A1 Jan. 11, 2018

Related U.S. Application Data

(60) Provisional application No. 61/867,345, filed on Aug. 19, 2013.

(51) Int. Cl.
*F41A 19/14* (2006.01)

(52) U.S. Cl.
CPC ..... *F41A 19/14* (2013.01)

(58) Field of Classification Search
CPC ..... F41A 17/46; F41A 17/74; F41A 19/14
See application file for complete search history.

(56) References Cited

U.S. PATENT DOCUMENTS

| | | | | | |
|---|---|---|---|---|---|
| 246,817 | A * | 9/1881 | Proeschel | F41A 19/53 | 42/65 |
| D138,594 | S | 8/1944 | Jack | | |
| 4,067,131 | A | 1/1978 | Ruger et al. | | |
| 4,122,622 | A * | 10/1978 | Angelino | F41A 19/14 | 42/65 |
| 4,833,809 | A | 5/1989 | Domian et al. | | |
| 5,335,437 | A | 8/1994 | Andersen | | |
| 6,305,114 | B1 * | 10/2001 | Saltz | F41A 19/14 | 42/66 |
| 7,140,138 | B1 | 11/2006 | Laney et al. | | |
| 7,269,919 | B2 | 9/2007 | Neumann | | |
| 8,443,536 | B1 | 5/2013 | Geissele | | |
| 8,572,879 | B2 * | 11/2013 | Tiangco | F41A 19/14 | 42/69.01 |
| 2006/0207147 | A1 | 9/2006 | Lazor | | |
| 2013/0167422 | A1 * | 7/2013 | Tiangco | F41A 19/14 | 42/69.01 |

* cited by examiner

*Primary Examiner* — Benjamin P Lee
(74) *Attorney, Agent, or Firm* — DeLio, Peterson & Curcio, LLC; Robert Curcio

(57) ABSTRACT

A rotatable spur for a handgun, rotatable with respect to the hammer body, and rotatable in a direction that is about an axis of rotation approximately parallel with the handgun body and barrel. The mechanism of rotation may be varied provided the spur is capable of changing the direction of its finger grip surface from its normal firing position to a position preferably perpendicular to the normal firing position. A retaining pin, biased for retention within an indentation within a cocking spur pin allows the finger grip surface of the spur to rotate and face at least a side position of the handgun.

7 Claims, 3 Drawing Sheets

HAMMER WITH ROTATABLE SPUR

BACKGROUND OF THE INVENTION

1. Field of the Invention

The present invention relates to firearms, preferably small firearms such as handguns. Specifically, the present invention relates to a firearm hammer having a rotatable and/or removable spur. The rotation enables the spur to rotate at least ninety degrees to place the spur top surface perpendicular from its normal firing position to relieve the chances of having the spur contact clothing when the handgun is concealed carried. The removal allows the spur to be completely removed from the handgun, and inserted at a subsequent time.

2. Description of Related Art

Many firearms including handguns, such as pistols and revolvers, are hammer fired. The hammer is a pivoting element near the breech of the gun barrel that is drawn back against spring tension, and released upon pulling the trigger. A forward face of the hammer pivots forward to strike the rear of a firing pin (or may itself including a firing pin) to strike the cartridge. The hammer typically has a spur, which is an extension that protrudes upward and/or rearward when the hammer is in the forward position, and which is engaged by the shooter's thumb to pull the hammer rearward to a cocked position in preparation for the next shot. Some firearms require cocking for each shot, and others such as semiautomatic pistols operate to automatically cock the hammer by the action of pulling the trigger or by the cycle of action.

Some firearms are provided with extension pieces that are bolted on to the spur, and which are essentially posts that extend laterally to the side of the spur, to allow the shooter to more easily grasp the spur, and place the spur beyond, for example, an the interfering scope. These extensions may be attached to the left or right side of the spur, depending on the handedness of the shooter.

In relation to smaller handguns that are typically used for concealed carry, the spur itself (independent of any additional extension) is a perpendicularly protruding object that is not only readily contacted by the shooter's thumb, but also by articles of clothing that the shooter wears during conceal carry. This clothing can obstruct the placement and removal of the firearm to and from the holster, and could unintentionally cock the firearm. The latter creates a serious safety problem, because a user may wrongly assume that because he has not manually cocked his firearm, it is safe for carrying about, when in fact the gun has been unknowingly cocked by inadvertent contact with clothing and is ready to fire.

Snagging the spur on articles of clothing, or having the spur inadvertently catch on an object on the person could compromise the comfort of the concealed carry firearm, and/or cause a safety and performance issue for the user. It would therefore be a benefit in the field of art to introduce a hammer-spur design that mitigates some of these prevalent issues in the prior art for concealed carry handguns.

SUMMARY OF THE INVENTION

Bearing in mind the problems and deficiencies of the prior art, it is therefore an object of the present invention to provide a handgun for concealed carry with a rotatable spur for adjusting the spur to eliminate or decrease obstructions and snags, and facilitate carrying the handgun.

It is another object of the present invention to provide a handgun that addresses the safety concerns of obstruction with material and objects when carrying, and help reduce the possibility of inadvertent cocking of the firearm.

The above and other objects, which will be apparent to those skilled in the art, are achieved in the present invention which is directed to a handgun having a grip and barrel in a vertical plane, comprising a hammer having a hammer body in the vertical plane, the hammer body including a spur rotatable with respect to the hammer body, the spur rotatable about an axis parallel to the vertical plane.

The spur includes a finger grip surface and a cocking spur pin, the cocking spur pin insertable within the hammer body through a first aperture, the cocking spur pin cylindrical in shape and having a radial indentation on one side.

The handgun includes a retaining pin insertable within a second aperture in the hammer body, the retaining pin having a receiving cut portion for slidably communicating with a locking pin.

The handgun further includes a third aperture within the hammer body for receiving the locking pin, the locking pin upon insertion within a third aperture of the hammer body being in slidable communication with the receiving cut of the retaining pin.

Preferably, a bias spring is in mechanical communication with the retaining pin, the bias spring insertable with the retaining pin within the second aperture such that, when the bias spring and the retaining pin are inserted within the second aperture, the locking pin upon insertion within the third aperture maintains the retaining pin biased against the bias spring.

The cocking spur pin is slidably locked by a retention force of the retaining pin acting with the bias spring for securing the spur in a position for firing.

The handgun may include a pistol or a revolver.

In a second aspect, the present invention is directed to a hammer for a handgun having a rotatable spur, comprising: a hammer body having a first, second, and third aperture, the hammer body in a vertical plane when the hammer is held upright; a spur having a finger grip surface and an elongated insertion segment for inserting within the first aperture of the hammer body, the spur elongated insertion segment including an indentation on at least one side for slidably responding to a biased retention pin in the hammer body; the biased retention pin having a notch in at least one side for receiving a locking pin; the biased retention pin combined with, and in mechanical communication with, a bias spring, the biased retention pin and spring combination insertable within the second aperture of the hammer housing; a locking pin insertable within the third aperture of the hammer body, the locking pin in slidable communication with the notch; such that the spur being rotatable with respect to and about an axis parallel to the vertical plane, the spur rotatable to at least ninety degrees.

In a third aspect, the present invention is directed to a hammer and rotatable spur combination for a handgun, comprising: a hammer having a hammer body for receiving the rotatable spur; a ball and spring retention located either in a body portion of the rotatable spur or in the hammer body; an indentation structure for receiving the ball, the indentation structure located within the hammer body when the ball and spring retention is located within the body portion of the rotatable spur, or the indentation structure located within the rotatable spur when the ball and spring retention is located within the hammer body.

In a fourth aspect, the present invention is directed to a method of concealed carrying a handgun, where the handgun comprises a vertical plane when held in the upright, firing position, the vertical plane defined by a plane passing through a grip and barrel of the handgun, the method including rotating a spur on a hammer of the handgun, the spur rotatably attached to the hammer, the spur rotatable about an axis parallel to the vertical plane.

The method further includes biasing the spur such that the spur rotation is rotatably fixed in a firing position, and is temporarily held in the firing position by a biasing component.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-3 of the drawings in which like numerals refer to like features of the invention.

The present invention overcomes the limitations of the prior art by providing a firearm hammer having a hammer body with a hammer pivot axis for attachment to a firearm frame. A spur is connected to the hammer body, and the spur is rotatable along an axis of rotation approximately perpendicular to the hammer axis of rotation and parallel to the vertical plane of the gun barrel. This axis of rotation allows the spur to rotate such that the finger grip portion of the spur, which is normally facing upward during firing, that is, has a spur top surface normal component that is parallel to the vertical plane of the handgun and hammer, rotates towards the side of the firearm. In this manner, the finger grip portion of the spur spins or rotates relative to the plane of the handgun.

Figure 1:
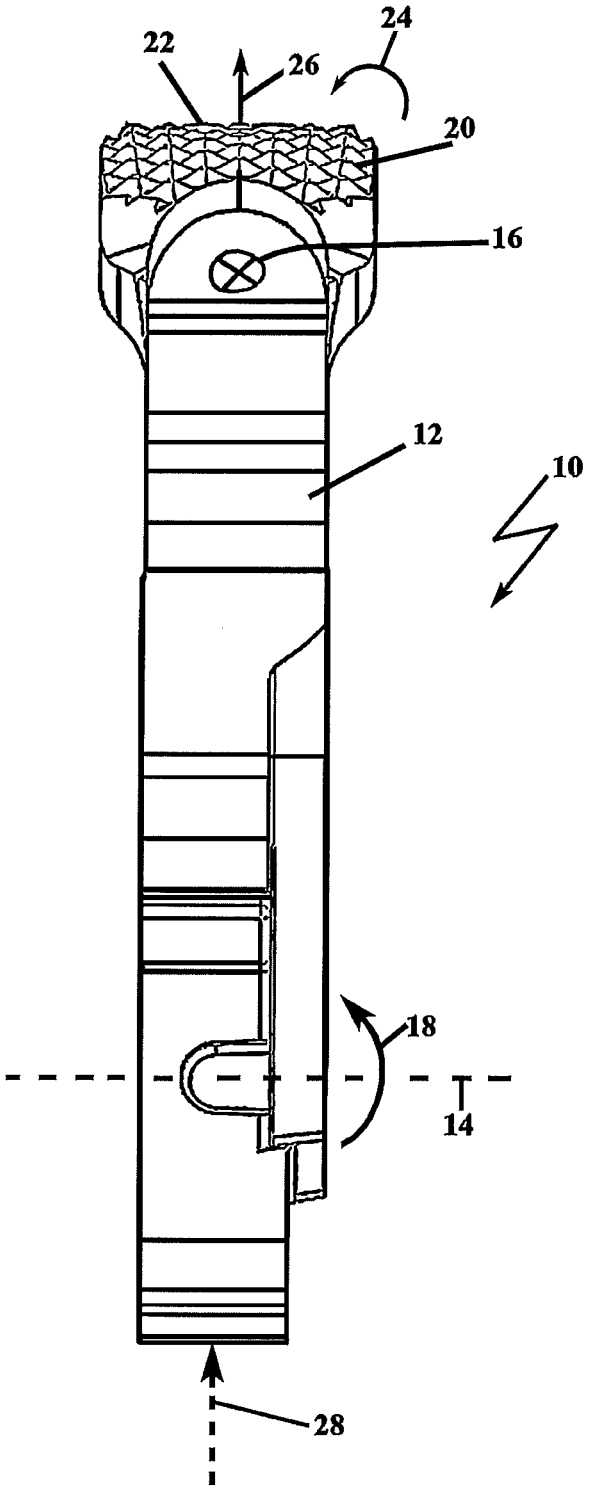
FIG. 1 depicts a first embodiment of the hammer-spur design of the present invention.

FIG. 1 depicts a first embodiment of the hammer-spur design of the present invention. Hammer 10 includes a hammer body 12 that receives and secures a rotatable spur mechanism. Hammer 10 rotates about an axis of rotation 14 that is perpendicular to axis that corresponds to the barrel of the firearm, which projects into the page in direction 16. The hammer is cocked by the user pressing down on the finger grip surface 22 of spur 20. When pressed downwards, hammer 10 rotates about axis of rotation 14 in direction 16, perpendicular to the axis of rotation 14.

Spur 20 is made to be rotatable with respect to hammer body 12. Spur 20 rotates about axis of rotation 16, which may be approximately parallel to the barrel of the firearm, and projects into and out of the page. The rotational direction 24 of spur 20 is in a direction about the axis of rotation 16. In this manner, finger grip surface 22 of spur 20 may be directed from its current position where the normal 26 of finger grip surface 22 is initially directed upward relative to the handgun, that is, parallel to the plane 28 of the handgun, towards a direction predominantly perpendicular to plane 28 of the handgun, facing outwards towards either side of the handgun.

Figure 2:
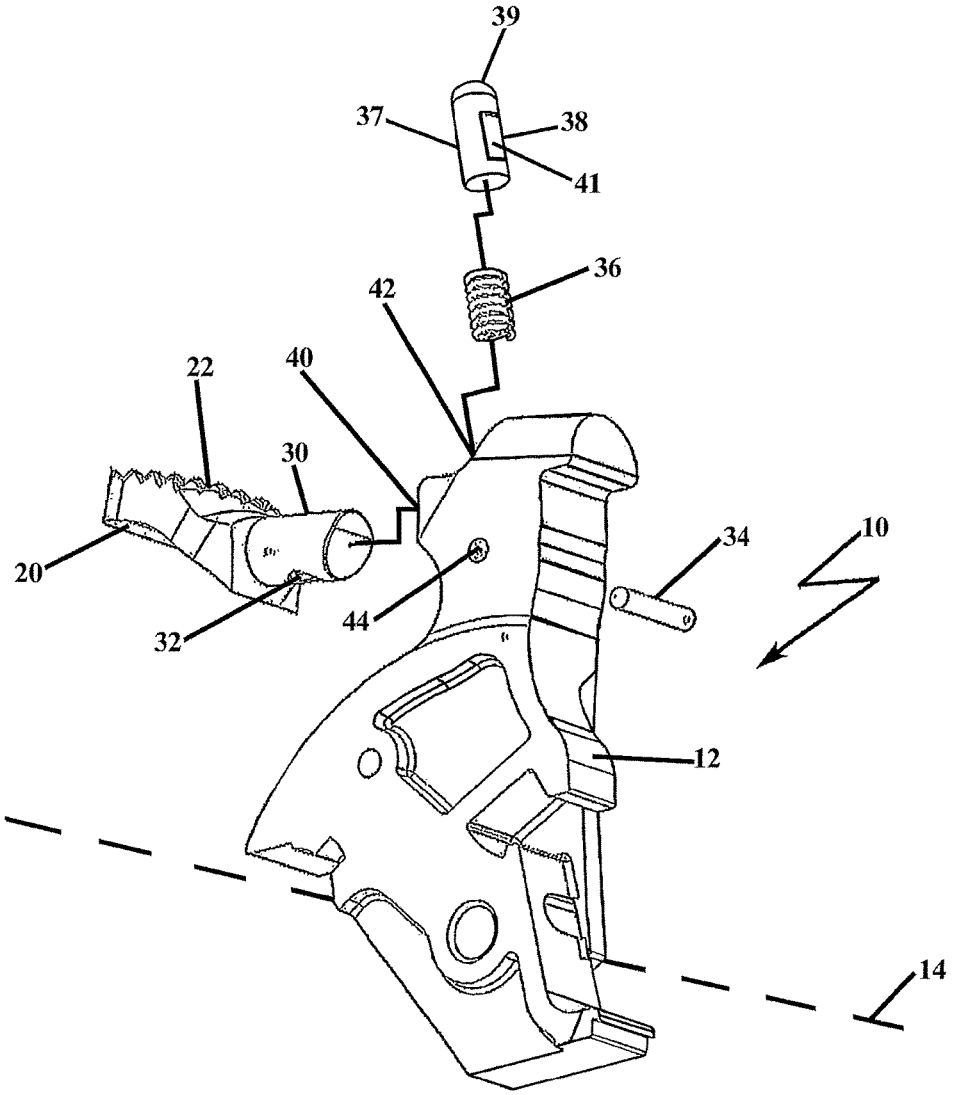
FIG. 2 depicts an exploded view of one embodiment of the hammer-spur configuration of the present invention.

An exploded view of one embodiment of the hammer-spur configuration of the present invention is represented by FIG. 2. Spur 20 attaches to hammer body 12 via a cocking spur pin 30, and is received in an aperture 40 at the top portion of the backside face of hammer body 12, that is, the side face of the hammer body opposite the muzzle end of the handgun. In one embodiment, cocking spur pin 30 includes an indentation 32 that is sized to fit retaining pin 38 when spur 20 is placed in its firing position, with finger grip portion 22 facing upwards. Retaining pin 38 is insertable in aperture 42 at the top of hammer body 12.

In this embodiment, retaining pin 38 has a primarily cylindrical body 37, with a rounded end 39 sized to fit indentation 32 of cocking spur pin 30. A receiving cut 41 is provided on one side of cylindrical body 37 which receives locking pin 34. Receiving cut 41 is an elongated, linear cut on the surface of cylindrical body 37, which allows retaining pin 38 up and down movement when in place within hammer body 12. Retaining pin 38 and retaining spring 36 are inserted within hammer aperture 42, compressing retaining spring 36 such that receiving cut 41 is centered about hammer aperture 44. Locking pin 34 is inserted within hammer aperture 44 to keep retaining pin 38 biased by retaining spring 36. Locking pin 34 inserts through hammer aperture 44 and mates with receiving cut 41. In this manner, locking pin 34 holds retaining pin 38 against retaining spring 36, which is biased to push retaining pin out of aperture 42. Spur 20 is then inserted within hammer aperture 40. Indentation 32 is sized to receive rounded end 39 of retaining pin 38 when the finger grip surface 22 of spur 20 is upright, in the firing position. Spur 20 is rotatable about aperture 40, and can be rotated to a position off its normal firing position. When rotated to a position off its normal firing position, finger grip surface 22 is shifted towards the perpendicular to its otherwise upright firing position, while spur 20 remains considerably within plane 28 of the handgun.

Figure 3:
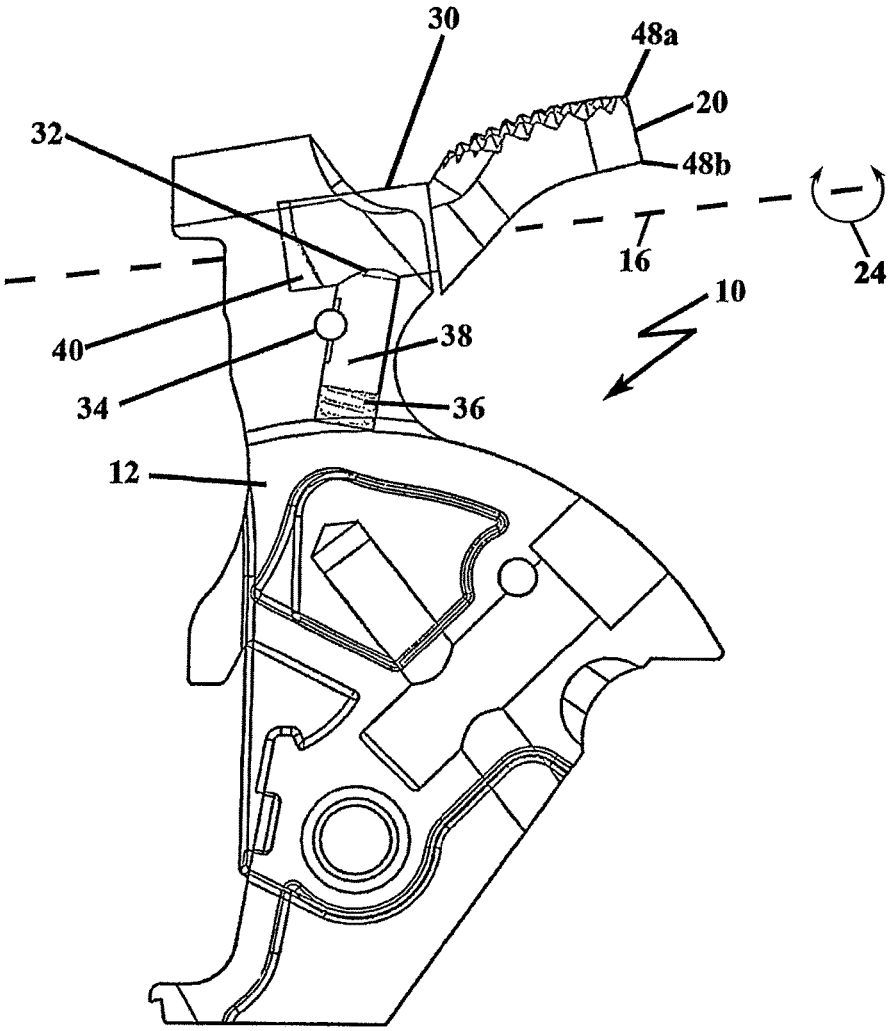
FIG. 3 depicts the preferred embodiment of the hammer-spur configuration in a rotated position.

FIG. 3 depicts the preferred embodiment of the hammer-spur configuration in a rotated position. Spur 20 is depicted rotated in a direction 24 about axis of rotation 16. In this rotated position, retaining pin 38 is depressed against bias retaining spring 36 as cocking spur pin 30 is rotated with spur 20, and indentation 32 is moved away from the biased retaining pin 38. Spur 20 may be rotatable a full 360°, although the present invention only requires rotating the finger grip surface 22 of spur 20 off its normal firing position so that point edges 48*a,b* are approximately parallel with the plane of the handgun, thus removing the point edges from obstruction with clothing and other objects during concealed carry of the firearm. Cocking spur pin 30 may further include additional indentations to allow retainer pin 38 to secure spur 20 in its newly rotated position.

Other attachment mechanisms may be employed to attach spur 20 to hammer body 12. For example, a ball and spring retention combination may be used instead of the retainer pin. The ball and spring combination could be housed in the hammer body or the cocking spur pin. The opposite mating surface would be an indentation for the biased ball, either on the hammer body or the cocking spur pin.

Additionally, the spur may be completely removable and insertable to eliminate the spur end points from obstruction during conceal carry. Such a spur need not be rotatable if ease of removing achieves the attributes of precluding eliminating or deleting obstructions and snags, and facilitating safely carrying the handgun.

In another embodiment, the cocking spur pin may be biased to the hammer body, in a manner that allows the spur to be partially extracted, rotated, and reinserted in a second position, or plurality of positions. The user would pull the spur outwards, rotate it, and the bias would pull the spur back to the hammer body in the new rotated position.

The present invention teaches a rotatable spur, rotatable with respect to the hammer body, and in a direction that is about an axis of rotation parallel with the handgun body and barrel. The mechanism of rotation may be varied provided the spur is capable of changing the direction of its finger grip surface from its normal firing position to a position preferably perpendicular to the normal firing position. The present invention also teaches the method of rotating a spur on a hammer of a handgun, as the rotation is depicted in the drawings.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A handgun having a grip and barrel in a vertical plane, comprising a hammer having a hammer body in said vertical plane, said hammer body including a spur rotatable with respect to said hammer body, said spur rotatable about an axis parallel to said vertical plane, said spur includes a finger grip surface and a cocking spur pin, said cocking spur pin insertable within said hammer body through a first aperture, said cocking spur having a radial indentation on one side, said first aperture located on a backside surface of said hammer opposite a muzzle side surface of said hammer; and a retaining pin insertable within a second aperture in said hammer body, said retaining pin having a receiving cut portion for slidably communicating with a locking pin, said second aperture located approximate said hammer body top surface.

2. The handgun of claim 1 including a third aperture within said hammer body for receiving said locking pin, said locking pin upon insertion within said third aperture of said hammer body being in slidable communication with said receiving cut of said retaining pin.

3. The handgun of claim 1 including a bias spring in mechanical communication with said retaining pin, said bias spring insertable with said retaining pin within said second aperture such that, when said bias spring and said retaining pin are inserted within said second aperture, said locking pin upon insertion within said third aperture maintains said retaining pin biased against said bias spring.

4. The handgun of claim 3 wherein said cocking spur pin is slidably locked by a retention force of said retaining pin acting with said bias spring for securing said spur in a position for firing.

5. The handgun of claim 1 wherein said handgun includes a pistol or a revolver.

6. A hammer for a handgun having a rotatable spur, comprising:

a hammer body having a first, second, and third aperture, said hammer body in a vertical plane when said handgun is held upright;

a spur having a finger grip surface and an elongated insertion segment for inserting within said first aperture of said hammer body, said spur elongated insertion segment including an indentation on at least one side for slidably responding to a biased retention pin in said hammer body, said spur being rotatable with respect to and about an axis parallel to said vertical plane; and a locking pin insertable within said third aperture of said hammer body, said locking pin in slidable communication with said notch;

wherein said biased retention pin includes a notch in at least one side for receiving said locking pin;

said biased retention pin combined with, and in mechanical communication with, a bias spring, said biased retention pin and spring combination insertable within said second aperture of said hammer housing.

7. The hammer of claim 6, wherein said spur is rotatable to at least ninety degrees.

* * * * *